US009370461B2

(12) United States Patent
Wang

(10) Patent No.: US 9,370,461 B2
(45) Date of Patent: Jun. 21, 2016

(54) TOUCH-TO-ACTIVATE STRUCTURE FOR MAKE-UP PEN WITH FUNCTION OF VIBRATION MASSAGE

(71) Applicant: BEAUTY AN TECHNOLOGY CO., LTD., New Taipei (TW)

(72) Inventor: Zhen-Zhen Wang, New Taipei (TW)

(73) Assignee: BEAUTY AN TECHNOLOGY CO., LTD., New Taipei (TW)

( * ) Notice: Subject to any disclaimer, the term of this patent is extended or adjusted under 35 U.S.C. 154(b) by 400 days.

(21) Appl. No.: 14/156,469

(22) Filed: Jan. 16, 2014

(65) Prior Publication Data

US 2014/0288469 A1 Sep. 25, 2014

(30) Foreign Application Priority Data

Mar. 22, 2013 (CN) ..... 2013 2 0133626 U

(51) Int. Cl.
*A61H 23/00* (2006.01)
*A61H 23/02* (2006.01)
*A45D 34/04* (2006.01)

(52) U.S. Cl.
CPC ..... *A61H 23/0263* (2013.01); *A45D 34/04* (2013.01); *A45D 2200/207* (2013.01); *A61H 2201/105* (2013.01); *A61H 2201/5028* (2013.01)

(58) Field of Classification Search
CPC ..... A61H 23/0263; A61H 2201/5028; A61H 2201/105; A61H 2201/0153; A61H 2201/12; A61H 2201/1207; A61H 2201/1215; A61H 2201/1692; A61H 2205/00; A61H 2205/022; A61H 2205/023; A61H 2205/024; A61H 2205/025; A45D 34/04; A45D 2200/207
See application file for complete search history.

(56) References Cited

U.S. PATENT DOCUMENTS

| | | | | |
|---|---|---|---|---|
| 4,203,431 | A * | 5/1980 | Abura | A61H 7/005 15/28 |
| 8,177,450 | B2 * | 5/2012 | Zhang | A45D 34/04 401/216 |
| 2003/0171702 | A1 * | 9/2003 | Thompson | A45D 33/02 601/72 |
| 2008/0138138 | A1 * | 6/2008 | Gueret | A45D 40/26 401/24 |
| 2011/0071445 | A1 * | 3/2011 | Imboden | A61H 19/30 601/46 |

* cited by examiner

*Primary Examiner* — Quang D Thanh
(74) *Attorney, Agent, or Firm* — Leong C. Lei

(57) ABSTRACT

A touch-to-activate structure for make-up pen with function of vibration massage receives and contains therein a liquid and includes a container body, a base, a vibration device, a shielding lid, a cover, a leakage prevention valve, a contact massage lid, and a hold-down cap. The shielding lid possesses elasticity blocks external moisture, and supports the vibration device to provide a waterproof effect. The vibration device includes a spring conductor. The container body, the base, the shielding lid, and the cover are in communication with each other and the leakage prevention valve that has a valve hole is movably mounted in an opening of the cover, whereby when the contact massage lid is touched and pressed down, the leakage prevention valve is moved to press and push the spring conductor so as to automatically activate a vibration function of the vibration device and also to have the valve hole shielded.

7 Claims, 4 Drawing Sheets

TOUCH-TO-ACTIVATE STRUCTURE FOR MAKE-UP PEN WITH FUNCTION OF VIBRATION MASSAGE

TECHNICAL FIELD OF THE INVENTION

The present invention generally relates to a make-up pen, and more particularly to a touch-to-activate structure for make-up pane with function of vibration massage.

DESCRIPTION OF THE PRIOR ART

A known massage make-up jar, such as U.S. Pat. No. 8,177,450 B2, which discloses a "structure for make-up pen with function of vibration massage", provides a function of vibration massage. However, to operate, the function of vibration massage can only be activated by pushing a switch device. Thus, such a patented device must include an additional switch device and thus show drawbacks of complicated and inconvenient operation and insufficient user-friendliness. Particularly, if the switch device is not pushed to shut down the device when the device is not be used further, loss of power may result and consequently, energy may get wasted.

Further, the known massage make-up does not include a leakage protection valve and thus does not have a function for stopping leakage. This increases the trouble of cleaning.

Further, the area where the make-up pen is often used generally includes bathrooms or other humid areas. Apparently, water resistance of the known massage make-up pen may not be perfect and this may easily lead to damping and damage of a massage device that is incorporated to generate the vibration massage effect. The waterproof rating of the present invention can protect electronics and functions from damage caused by being dipped in water or massage operations performed under water.

SUMMARY OF THE INVENTION

The object of the present invention is to provide a touch-to-activate structure for make-up pen with function of vibration massage, which can generate an effect of vibration massage when touched and pressed and includes functions of preventing drop leakage and sideways leakage.

To achieve the above objects, the present invention comprises a container body, a base, a vibration device, a shielding lid, a cover, a leakage prevention valve, a contact massage lid, and a hold-down cap, wherein the container body has an open mouth; the base is mounted in the open mouth of the container body, the base having at least one through hole; a vibration device is mounted to the base, the vibration device comprising a vibration member, a spring conductor, and a power supply unit, where the vibration member, the spring conductor, the power supply unit selectively establish electric connection therebetween; the shielding lid is made of an elastic material and is mounted in the base, the shielding lid shielding the vibration device, the shielding lid having at least one through aperture, the through aperture being in communication with the through holes of the base; the cover is mounted to the shielding lid, the cover having an opening; the leakage prevention valve comprising a valve hole, the leakage prevention valve being movably mounted in the opening of the cover to press against the shielding lid so as to press against the spring conductor to activate the vibration member of the vibration device and also to have the valve hole shielded and blocked by an inside surface of the opening of the cover; the contact massage lid comprises an egress hole, the egress hole being in communication with the valve hole of the leakage prevention valve; and the hold-down cap is mounted to the base to retain the contact massage lid.

The shielding lid possesses elasticity and shields the vibration device to provide a waterproof effect. When the contact massage lid is touched and pressed down, the leakage prevention valve is moved to press against the shielding lid and the spring conductor, so as to automatically activate a vibration function of the vibration device and also to have the valve hole of the leakage prevention valve shielded and blocked to prevent liquid from flowing out thereby providing a function of preventing drop leakage and sideway leakage.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
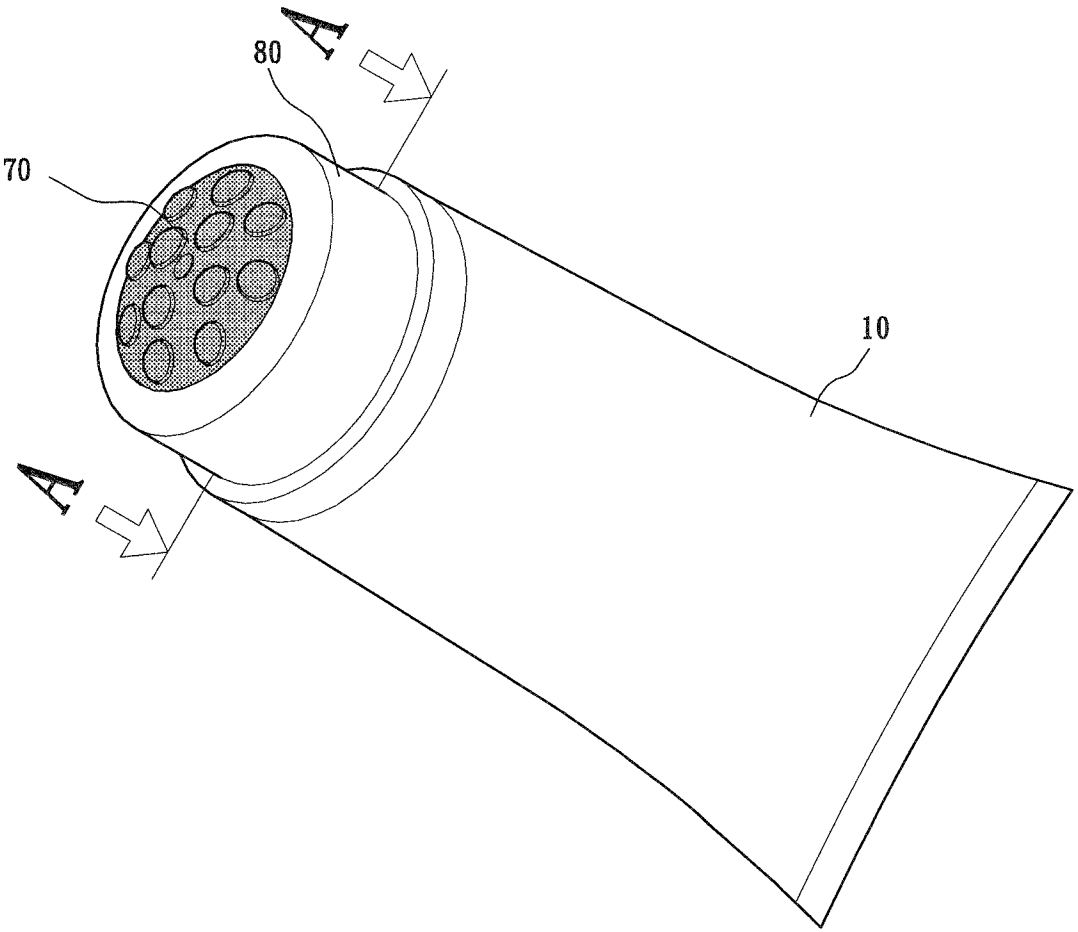
FIG. 1 is a perspective view of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1, 2, 3, and 5, an embodiment of the present invention comprises: a container body 10, which receives and contains a liquid for make-up or beautification, the container body 10 having an open mouth 11; a base 20, which is mounted to the open mouth 11 of the container body 10, the base 20 having two through holes 21; a vibration device 30, which is arranged in the base 20, the vibration device 30 comprising a vibration member 31, a spring conductor 32, and a power supply unit 33, wherein the vibration member 31, the spring conductor 32, and the power supply unit 33 are arranged to selectively establish electrical connection therebetween, whereby the vibration member 31 may generate a vibration function and the spring conductor 32 is normally not depressed and is thus not in contact with the vibration member 31 thereby opening a power circuit associated with the vibration member 31 and thus not activating the vibration function of the vibration member 31; a shielding lid 40, which is made of an elastic material and thus possesses elasticity and is mounted in the base 20, the shielding lid 40 covering the vibration device 30, the shielding lid 40 having two through apertures 41, the through apertures 41 being respectively in communication with the through holes 21 of the base 20; a cover 50, which is mounted to the shielding lid 40, the cover 50 having an opening 51, where the cover 50 and the shielding lid 40 define therebetween a space of a predetermined size to provide a path for the liquid to flow therethrough; a leakage prevention valve 60, which comprises a valve hole 61, the leakage prevention valve 60 being movably mounted in the opening 51 of the cover 50 to press against the shielding lid 40 so as to press against the spring conductor 32 to activate the vibration member 31 of the vibration device 30 and also to have the valve hole 61 shielded by an inside surface of the opening 51 of the cover 50; a contact massage lid 70, which comprises an egress hole 71, where the egress hole 71 is in communication with the valve hole 61 of the leakage prevention valve 60; a hold-down cap 80, which is mounted to the base 20, wherein in the instant embodiment, the hold-down cap 80 is threadingly coupled to the base 20 and the hold-down cap 80 comprises a hollow portion through which a surface of the contact massage lid 70 is exposed in such a way that a circumference of the hollow portion helps retain the contact massage lid 70.

As such, the shielding lid 40 possesses elasticity and shields the vibration device 30 to provide a waterproof effect (of which the waterproof rating can reach as high as IPX6). When the contact massage lid 70 is touched and pressed down (for example the contact massage lid 70 being brought to contact human skin), the leakage prevention valve 60 is pushed by the contact massage lid 70 to move upward and thus press against the shielding lid 40. Since the shielding lid 40 is elastically deformable due to the elastic material thereof to press against and push the spring conductor 32, the spring conductor 32 is caused to deform upward to contact the vibration member 31, leading to closing of the power circuit of the vibration member 31 and thus automatically activating the vibration function of the vibration device 30 to enable the contact massage lid 70 to generate an effect of vibration massage. Further, under this condition, two lateral side ends of the valve hole 61 of the leakage prevention valve 60 are shielded and blocked by the inside surface of the opening 51 of the cover 50 so as to prevent the liquid to flow out through the valve hole 61 and the egress hole 71 of the contact massage lid 70 and thus achieving a function of preventing drop leakage and sideway leakage to effectively overcome the problem of the known massage make-up pen that requires inclusion of an additional switch due to a power supply box being separately mounted.

Figure 4:
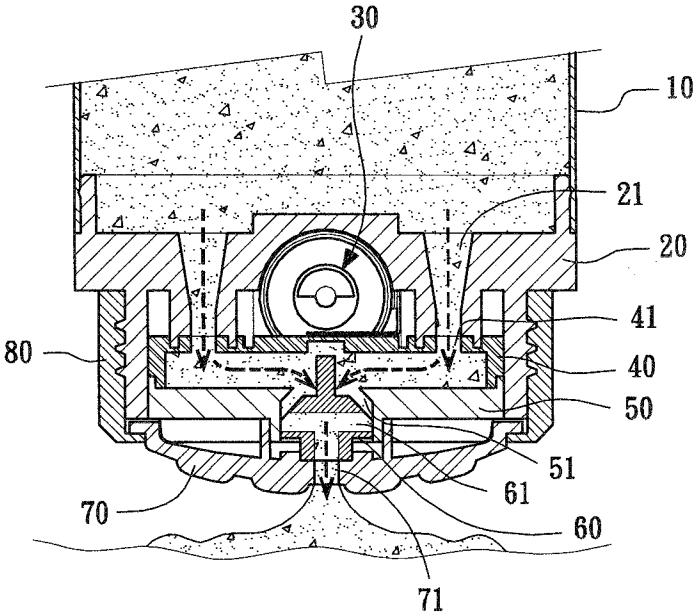
FIG. 4 is a schematic view illustrating an operation of the present invention.

Referring to FIGS. 1 and 4, in an embodiment, the container body 10 is made of a flexible material and is flexible and deformable to allow for squeezing out the liquid for make-up or beautification contained therein.

Figure 2:
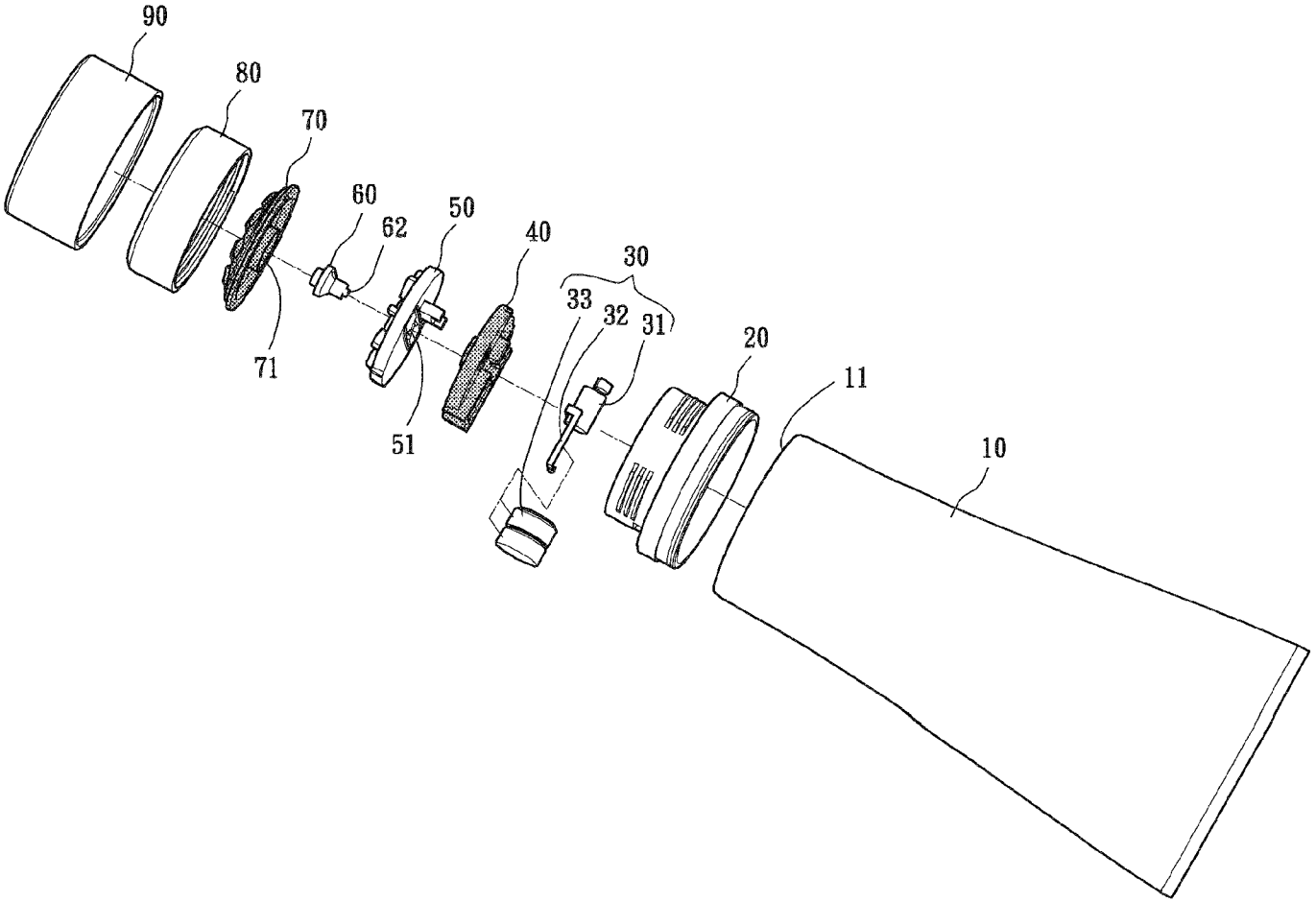
FIG. 2 is an exploded view of the present invention.
Figure 3:
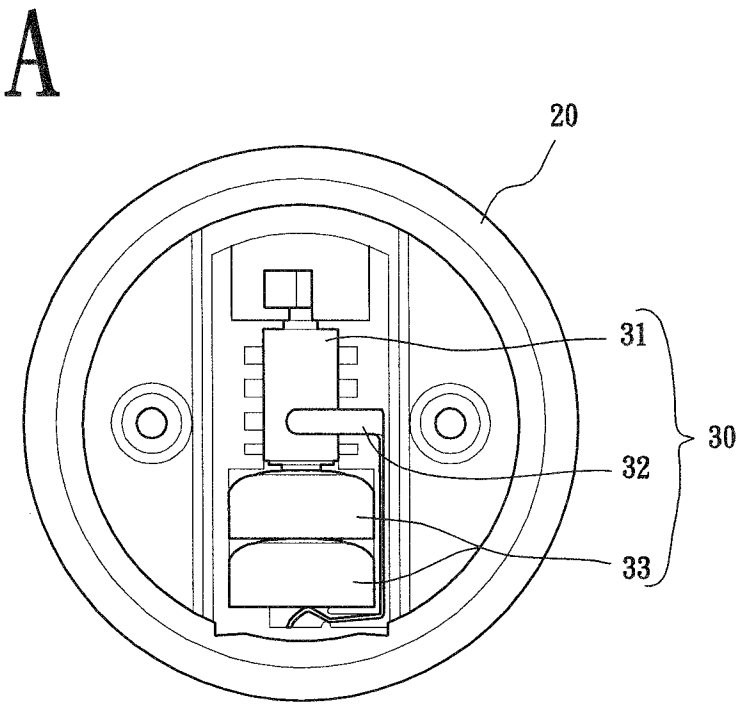
FIG. 3 is a cross-sectional view taken along line A-A of FIG. 1.

Referring to FIGS. 2, 3, and 4, in an embodiment, the vibration member 31 is a vibration motor and the vibration motor comprises a prime mover spindle having an eccentric block attached thereto.

In an embodiment, the spring conductor 32 is a metal spring plate so that the spring conductor 32 is readily deformable upward to contact the vibration member 31.

Referring to FIGS. 2 and 4, in an embodiment, the shielding lid 40 is made of a waterproof rubber material to effectively and hermetically shield the vibration device 30 for enhancing the waterproof effect.

Figure 5:
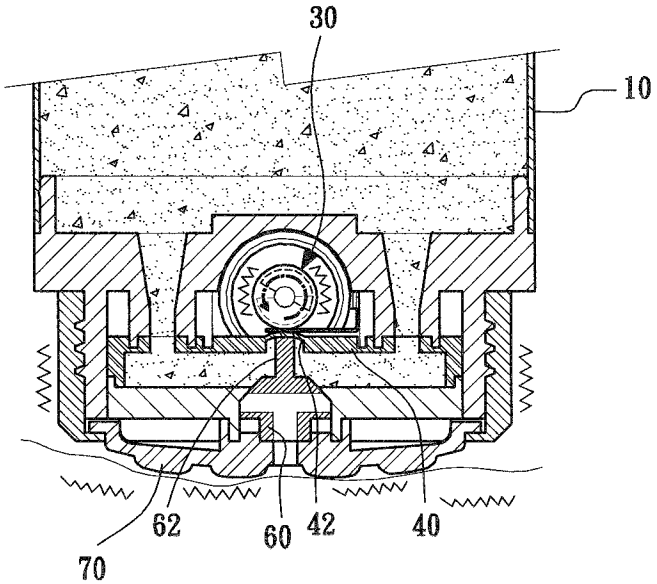
FIG. 5 is a schematic view illustrating an operation of the present invention.

Referring to FIGS. 4 and 5, in an embodiment, the valve hole 61 of the leakage prevention valve 60 is T-shaped, whereby when the leakage prevention valve 60 is moved downward, three side ends of the valve hole 61 are all open ends so that the liquid can flow through the two lateral side ends into the valve hole 61 and then flow out through the bottom side end of the valve hole 61. When the leakage prevention valve 60 is moved upward, the two lateral side ends of the valve hole 61 of the leakage prevention valve 60 are shielded and blocked by the inside surface of the opening 51 of the cover 50 so as to prevent the liquid from flowing through the valve hole 61 to get out of the egress hole 71 of the contact massage lid 70.

Referring to FIGS. 4 and 5 again, in an embodiment, the leakage prevention valve 60 comprises a stem 62 and the shielding lid 40 comprises a recess 42, where the recess 42 and the stem 62 correspond to each other, whereby upward movement of the leakage prevention valve 60 results in contact and press against the shielding lid 40 to cause deformation thereof and thus achieving an effect of pressing down.

Referring to FIGS. 1, 4, and 5, in an embodiment, the contact massage lid 70 is made of an elastic material and thus possesses elasticity so as to be deformable when being touched and pressed to push the leakage prevention valve 60 to move upward.

Referring to FIG. 2, in an embodiment, the present invention comprises an external cover 90, where the external cover 90 is attachable to the hold-down cap 80 to protect the contact massage lid 70.

Referring to FIG. 4, an example of an operation of the present invention for enabling liquid to flow out is shown. When the container body 10 is squeezed, the liquid contained in the container body 10 is caused to generate an outward pushing force to thereby driving the leakage prevention valve 60 to move downward. Under this condition, the two lateral side ends of the valve hole 61 of the leakage prevention valve 60 are not shielded and blocked by the inside surface of the opening 51 of the cover 50 (meaning all three side ends of the valve hole 61 are open ends), so that the liquid is allowed to flow through the valve hole 61 to get out of the egress hole 71 of the contact massage lid 70.

In summary, embodying the present invention would provide at least the following operation features:

(1) The duration of vibration can reach at least approximately 16,200-19,800 seconds and the supply of electricity can last for at least 280 minutes.

(2) No switch is needed and operation can be activated immediately upon touching. Particularly, no vibration will be caused in a non-use condition so that negligence of forgetting to push the switch to shut down the device, which leads to loss of power and waste of energy can be prevented.

(3) The waterproof rating can reach IPX6, so that device can maintain the waterproof function even though dropping into water or dipped in water, provided it is picked out of water within a predetermined period of time, and thus, no damage will be caused on the electronics and motor.

(4) No leakage of emulsion will occur during the operation of vibration massage. The conventional massage make-up pen comprises no leakage prevention valve and sideway leakage of the massage emulsion may occur at the same time when vibration massage is performed and this leads to waste and environmental pollution.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A touch-to-activate structure for make-up pen with function of vibration massage, which is adapted to receive and contain a liquid therein and comprises:

a container body, which has an open mouth;

a base, which is mounted to the open mouth of the container body, the base comprising at least one through holes a vibration device, which is mounted in the base, the vibration device comprising a vibration member, a spring conductor, and a power supply unit, the vibration member, the spring conductor, and the power supply unit selectively establishing electric connection therebetween;

a shielding lid, which is made of an elastic material and is mounted in the base, the shielding lid shielding the vibration device, the shielding lid having at least one through aperture, the through aperture being in communication with the through hole of the base;

a cover, which is mounted to the shielding lid, the cover having an opening;

a leakage prevention valve, which comprises a valve hole, the leakage prevention valve being movably mounted in the opening of the cover to press against the shielding lid so as to press against spring conductor to activate the vibration member of the vibration device and also to have the valve hole shielded by an inside surface of the opening of the cover;

a contact massage lid, which comprises an egress hole, the egress hole being in communication with the valve hole of the leakage prevention valve; and a hold-down cap, which is mounted to the base to retain the contact massage lid.

2. The touch-to-activate structure for make-up pen with function of vibration massage according to claim 1, wherein the container body is made of a flexible material.

3. The touch-to-activate structure for make-up pen with function of vibration massage according to claim 1, wherein the vibration member is a vibration motor and the vibration motor comprises a prime mover spindle having an eccentric block attached thereto.

4. The touch-to-activate structure for make-up pen with function of vibration massage according to claim 1, wherein the spring conductor is a metal spring plate.

5. The touch-to-activate structure for make-up pen with function of vibration massage according to claim 1, wherein the shielding lid is made of a waterproof rubber material.

6. The touch-to-activate structure for make-up pen with function of vibration massage according to claim 1, wherein the valve hole is T-shaped.

7. The touch-to-activate structure for make-up pen with function of vibration massage according to claim 1, wherein the contact massage lid is made of an elastic material.

* * * * *